US005876246A

United States Patent [19]

Martin et al.

[11] Patent Number: 5,876,246

[45] Date of Patent: Mar. 2, 1999

[54] ELECTRICAL CONNECTOR HAVING ACCESSORY MOUNTING PROVISION

[75] Inventors: Darryl Craig Martin, Kernersville; Todd Edwin Harriman, Lexington, both of N.C.

[73] Assignee: The Whitaker Corporation, Wilmington, Del.

[21] Appl. No.: 804,786

[22] Filed: Feb. 22, 1997

[51] Int. Cl.[6] ..... H01R 13/73

[52] U.S. Cl. ..... 439/557; 439/567

[58] Field of Search ..... 439/352, 358, 439/357, 552, 555, 353, 557, 567, 595, 607

[56] References Cited

U.S. PATENT DOCUMENTS

| | | | |
|---|---|---|---|
| 3,573,716 | 4/1971 | Garver | 439/353 |
| 4,108,527 | 8/1978 | Douty et al. | 439/465 |
| 4,323,295 | 4/1982 | Davis, Jr. | 439/465 |
| 4,575,174 | 3/1986 | Leeds et al. . | |
| 4,606,596 | 8/1986 | Whiting et al. | 439/465 |
| 4,708,662 | 11/1987 | Klein | 439/357 |
| 4,900,277 | 2/1990 | Inaba et al. | 439/752 |
| 4,944,693 | 7/1990 | Puerner | 439/358 |
| 4,979,915 | 12/1990 | Pitts | 439/595 |
| 5,716,227 | 2/1998 | Detter | 439/358 |
| 5,762,513 | 6/1998 | Stine | 439/404 |

*Primary Examiner*—Neil Abrams
*Assistant Examiner*—Brian J. Biggi
*Attorney, Agent, or Firm*—Robert J. Kapalka; Anton P. Ness

[57] ABSTRACT

An electrical connector comprises a dielectric housing having a pair of accessory mounting stations integrally formed with the housing on respective opposite sides of the housing, and a pair of resilient latch arms extending forwardly from respective ones of the accessory mounting stations. In a preferred embodiment, each of the accessory mounting stations includes a lug extending laterally from the housing and a beam extending forwardly from the lug. The lugs are configured to be gripped by an accessory to the connector. The beams flank the housing and are spaced from the housing, thereby defining pockets which are configured to receive portions of the accessory.

8 Claims, 3 Drawing Sheets

ELECTRICAL CONNECTOR HAVING ACCESSORY MOUNTING PROVISION

FIELD OF THE INVENTION

The invention relates to an electrical connector which is adapted to have an accessory such as a strain relief attached thereto.

BACKGROUND OF THE INVENTION

An electrical connector which is terminated to ends of wires often has a strain relief which prevents any stresses that are applied to the wires from being transferred to wire joints in the connector, thereby preventing damage to the wire joints or pullout of the wires from the connector. Typical strain reliefs are disclosed in U.S. Pat. Nos. 4,108,527; 4,575,174; and 4,606,596. Each of these strain reliefs includes mating upper and lower cover members which are configured to substantially surround a connector housing. The cover members clamp onto wires at a rear of the connector housing and engage a flange or forward face of the connector housing. When the wires are subjected to a force tending to pull the wires out of the housing, the force is transferred by the cover members to the flange or forward face of the housing, thereby bypassing the wire joints and protecting the joints from damage.

The above-described strain reliefs are not well-suited for a panel mount electrical connector which resides in a cutout of a mounting panel because a cutout which is sized to accommodate a connector without a strain relief cannot accommodate a connector with a strain relief, and vice versa. Further, the typical strain relief cover requires a relatively large cutout. There is a need for an electrical connector which improves the mounting of a strain relief or other accessory on the connector.

SUMMARY OF THE INVENTION

An electrical connector according to the invention comprises a dielectric housing having contact-receiving cavities extending into the housing from a front face thereof, a pair of accessory mounting stations integrally formed with the housing on respective opposite sides of the housing, and a pair of resilient latch arms extending forwardly from respective ones of the accessory mounting stations.

In a preferred embodiment, each of the accessory mounting stations includes a lug extending laterally from the housing and a beam extending forwardly from the lug. The lugs are configured to be gripped by an accessory to the connector. The beams flank the housing and are spaced from the housing, thereby defining pockets which are configured to receive portions of the accessory.

BRIEF DESCRIPTION OF THE DRAWINGS

The invention will now be described by way of example with reference to the accompanying drawings wherein.

DETAILED DESCRIPTION OF THE PREFERRED EMBODIMENT

Figure 5:
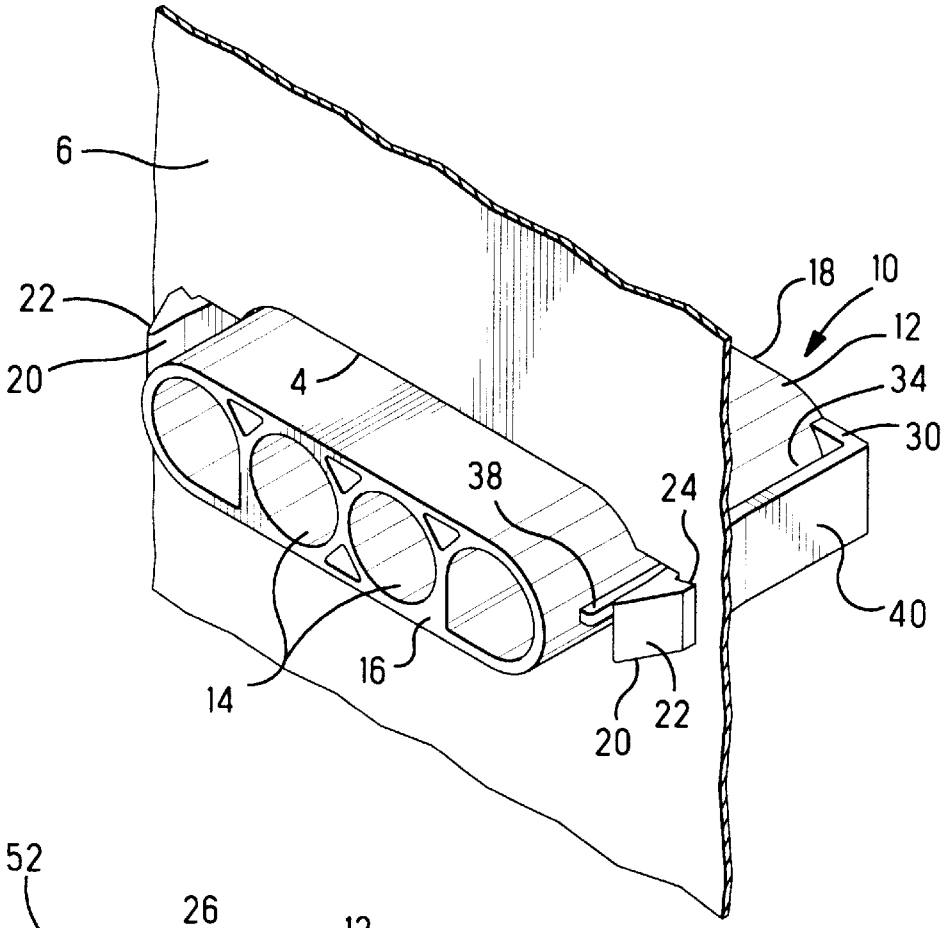
FIG. 5 is a top front isometric view of the connector installed in a mounting panel.

There is shown in the drawings an electrical connector 10 according to the invention comprising a dielectric housing 12 having contact-receiving cavities 14 which extend longitudinally through the housing from a front face 16 to a rear face 18. The connector shown is a panel mount type which can be received and latchably secured in a cutout 4 of a mounting panel 6, as shown in FIG. 5. However, it should be understood that novel features of the invention may be incorporated in other types of electrical connectors which are not of the panel mount type but which are latchably securable to mating connectors.

Figure 3:
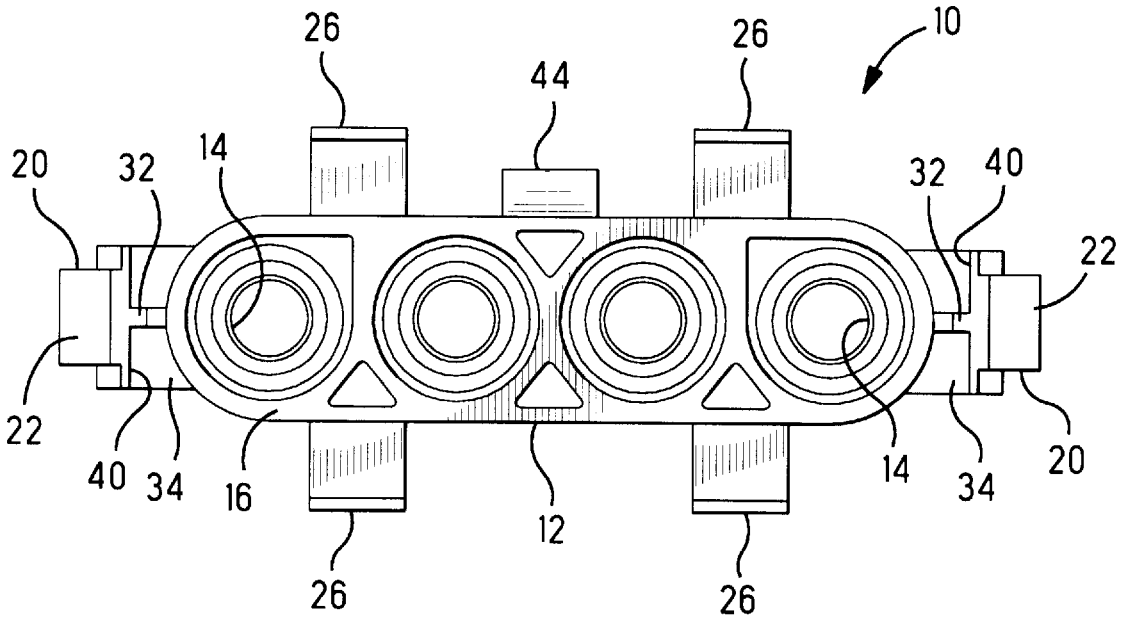
FIG. 3 is a front view of the connector.
Figure 4:
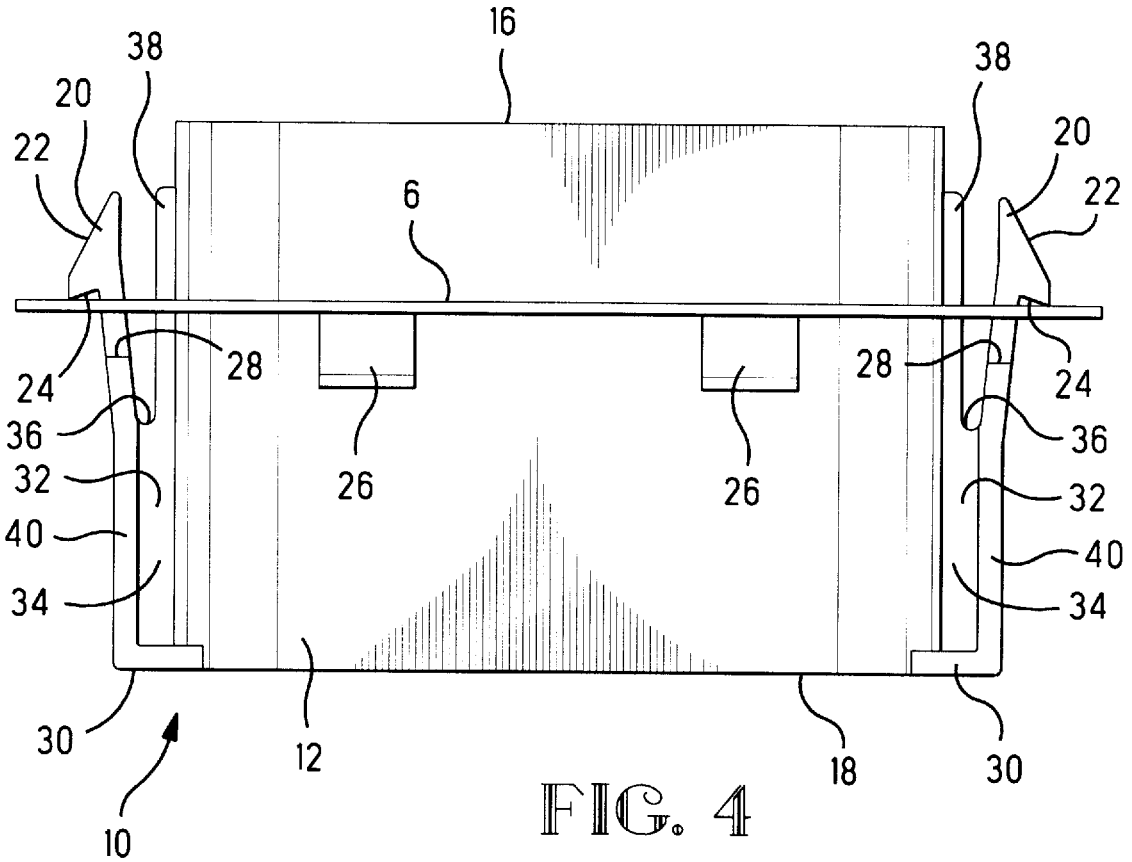
FIG. 4 is a top view of the connector installed in a mounting panel.

The connector 10 has a pair of resilient latch arms 20 which are integrally formed with the housing 12 on respective opposite sides thereof. The latch arms 20 are connected to the housing 12 by accessory mounting stations which include lugs 30 and beams 40. The lugs 30 extend laterally from opposite sides of the housing proximate the rear face 18, and the beams 40 extend forwardly from the lugs 30 until transforming into the latch arms 20. Each lug 30 extends in a plane generally parallel to rear face 18 and defines a forwardly facing major surface and opposed side edges. The lugs 30 and the beams 40 are rigidly connected to the housing 12 by gussets 32 which are disposed medially of the height of the beams 40, as shown in FIG. 3, thereby defining pockets 34 between the beams 40 and the housing 12 both above and below each of 20 the gussets 32, with each pocket 34 having open sides at the opposed side edges of the lugs. The beams 40 are transformed into the latch arms 20 at forward ends 36 of the gussets 32, as shown in FIG. 4. The latch arms 20, being cantilevered forwardly of the beams 40, are resiliently deflectable in the lateral direction toward the housing. Ribs 38 are dimensioned to limit the deflection range of the latch arms 20, thereby providing overstress protection for the latch arms.

The latch arms 20 have forward inclined surfaces 22 and rearward locking surfaces 24. The inclined surfaces 22 engage edges of the cutout in the mounting panel 6, shown in FIGS. 4 and 5, as a front of the housing is inserted through the panel from a back thereof, thereby deflecting the latch arms 20 toward the housing. When the locking surfaces 24 emerge beyond a front side of the panel, the arms 20 resile and move the locking surfaces 24 beyond the edges of the cutout, thereby capturing the panel between the locking surfaces 24 and anti-rattle wings 26, as shown in FIG. 4. The anti-rattle wings are somewhat deflectable in fore and aft directions, and the latch arms 20 are formed with stop surfaces 28 that will engage the mounting panel 6 to prevent the connector 10 from being pulled completely through the panel.

Figure 1:
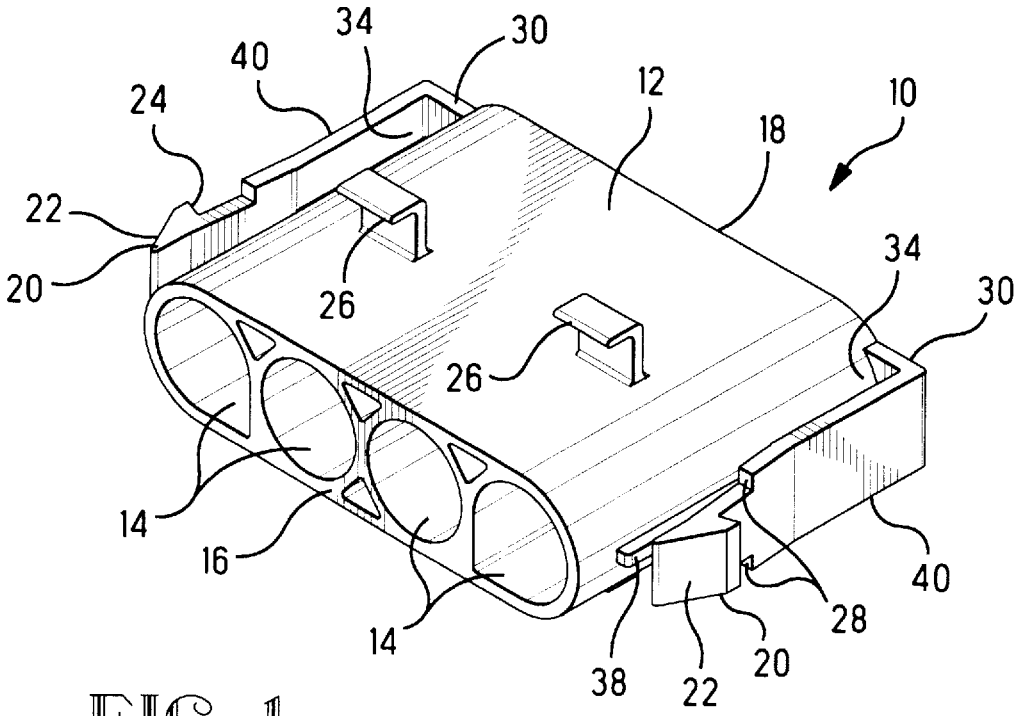
FIG. 1 is a top front isometric view of a connector according to the invention.
Figure 2:
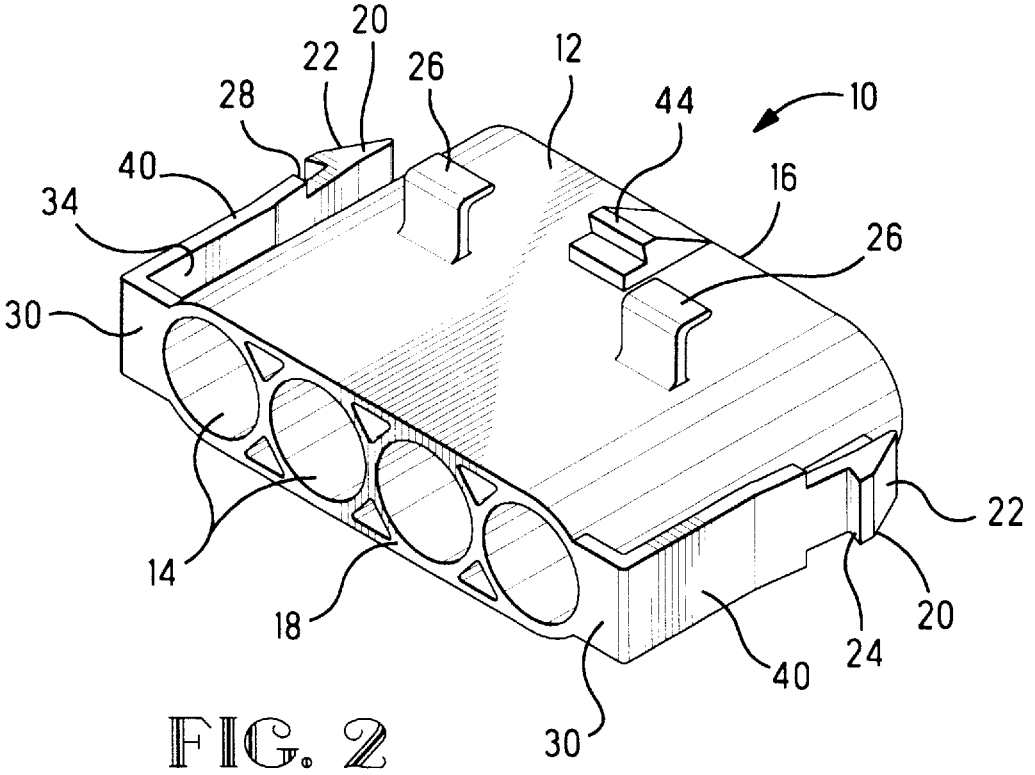
FIG. 2 is a top rear isometric view of the connector.

As best seen in FIG. 2, the housing has a projection 44 which is engageable by a latch of a mating electrical connector (not shown) so that the mating connectors can be secured together.

Figure 6:
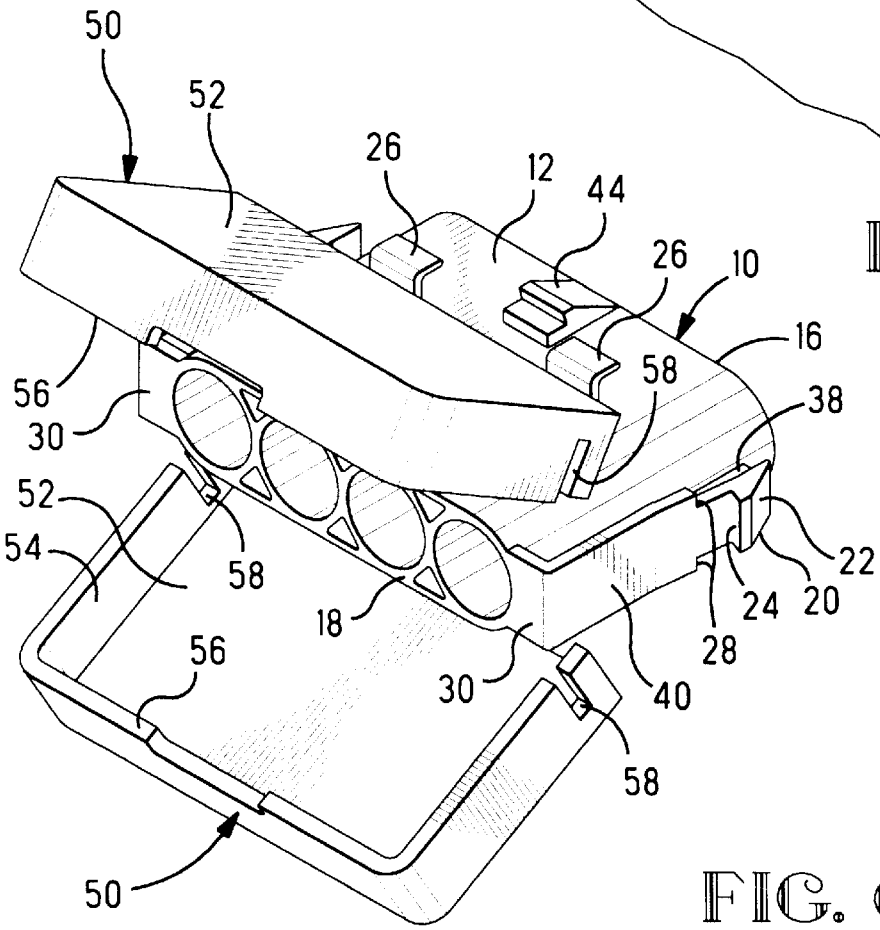
FIG. 6 is a top rear isometric view of the connector and an accessory disposed for attachment thereto.

An accessory for the electrical connector is shown in representative form in FIG. 6. The accessory includes a pair of mating cover members 50 each having a main wall 52, side walls 54 and a rear wall 56. Each of the side walls 54 has a notch 58 which is dimensioned to receive a portion of one of the lugs 30 therein so that a portion of each side wall 54 forward of the notch 58 can be inserted in a respective one of the pockets 34. The cover members 50 may be secured together by a suitable fastening means such as latches or screws. The lugs 30 provide a means for positioning the accessory on the connector housing 12. If the accessory is a strain relief, the lugs will accept forces which the strain relief must transfer from the wires to the connector housing.

The invention provides an electrical connector with an integrated accessory mounting station and panel latch arm. The accessory mounting station is at a rear of the connector, and the panel latch arm is forward of the mounting station, thereby permitting the connector, either with or without an accessory, to be installed in a single size hole in a mounting panel. The accessory mounting station includes a pocket which receives a complementary structure of the accessory so that the accessory will be positioned and stabilized on the connector.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector comprising:

a dielectric housing having contact-receiving cavities extending into the housing from a front of the housing, a pair of accessory mounting stations integrally formed with the housing on respective opposites sides of the housing at a rear of the housing, each of the accessory mounting stations including a laterally extending lug and a substantially rigid, forwardly extending beam, the lug extending to an end and being generally in a plane parallel to the rear of the housing and defining a forwardly facing major surface and opposed side edges, and the beam extending forwardly from the forwardly facing major surface of the lug, the beam and the lug together defining a pocket that has open sides and is configured to receive a portion of an accessory forwardly of the forwardly facing major surface of the lug for mounting the accessory at the rear of the housing, and a pair of resilient latch arms connected to and extending forwardly from respective ones of the forwardly extending beams.

2. The electrical connector according to claim 1, wherein the lug and the beam are connected to the housing by a gusset.

3. The electrical connector according to claim 2, wherein the lug and the beam extend vertically above and below the gusset.

4. The electrical connector according to claim 2, wherein the resilient latch arm comprises a portion of the beam that is forward of the gusset.

5. An electrical connector comprising:

a dielectric housing having contact-receiving cavities extending into the housing from a front of the housing, a pair of lugs extending laterally from respective opposite sides of the housing at a rear of the housing, the lugs extending to respective ends and being generally in planes parallel to the rear of the housing and each defining a forwardly facing major surface and opposed side edges, the lugs thereby being configured to be gripped by an accessory at the rear of the housing, and a pair of latch arms which are connected to and extend forwardly from respective ones of the lugs.

6. The electrical connector according to claim 5, wherein each of the latch arms includes a beam that is rigidly connected to the housing adjacent to its said lug, and a resilient portion that extends forwardly from the beam.

7. The electrical connector according to claim 6, wherein the lug and the beam are interconnected by a gusset.

8. The electrical connector according to claim 7, wherein the lug and the beam extend vertically above and below the gusset.

* * * * *